United States Patent [19]

Tieche

[11] Patent Number: 4,720,937

[45] Date of Patent: Jan. 26, 1988

[54] AUTOMATIC DEBURRING MACHINE FOR PARTS OF SMALL SIZE

[75] Inventor: Robert Tieche, St. Clement, France

[73] Assignee: Societe Elan, Sens, France

[21] Appl. No.: 865,668

[22] Filed: May 22, 1986

[30] Foreign Application Priority Data

Sep. 10, 1985 [FR] France ..... 85 13405

[51] Int. Cl.[4] ..... B24B 7/00

[52] U.S. Cl. ..... 51/76 R

[58] Field of Search ..... 51/76, 74 R; 198/628

[56] References Cited

U.S. PATENT DOCUMENTS

| | | | |
|---|---|---|---|
| 1,544,185 | 6/1925 | Schnell | 51/76 R |
| 2,236,078 | 3/1941 | Walter | 51/76 R |
| 2,273,509 | 2/1942 | Baren | 198/628 |
| 2,490,381 | 12/1949 | Shields | 198/628 |
| 2,715,796 | 8/1955 | Beard | 51/76 R |
| 3,435,566 | 4/1969 | Enserink | 51/76 R |
| 3,528,338 | 9/1970 | Cuma | 51/76 R |
| 3,918,573 | 11/1975 | Farney | 198/628 |

*Primary Examiner*—Harold D. Whitehead

*Attorney, Agent, or Firm*—D. L. Tschida

[57] ABSTRACT

Abrasive grinding apparatus wherein abrasive heads rotate about axes inclined at forty-five degrees to the longitudinal axis of a parts conveyor mat and in orthogonal relation to one another. Watering tracks positioned in overlying axially parallel relation to the abrasive heads and in transverse relation at the end and beneath the conveyor mat wash the exiting parts and the conveyor mat. Parts engaging pressing members comprised of a plurality of spring biased support frames each bearing a rotative, longitudinally displaced belt and having beveled sides adjacent the abrasive heads guide and maintain the parts in contact with the conveyor mat as they are transferred to and from the abrasive heads.

13 Claims, 3 Drawing Figures

AUTOMATIC DEBURRING MACHINE FOR PARTS OF SMALL SIZE

Figure 1:
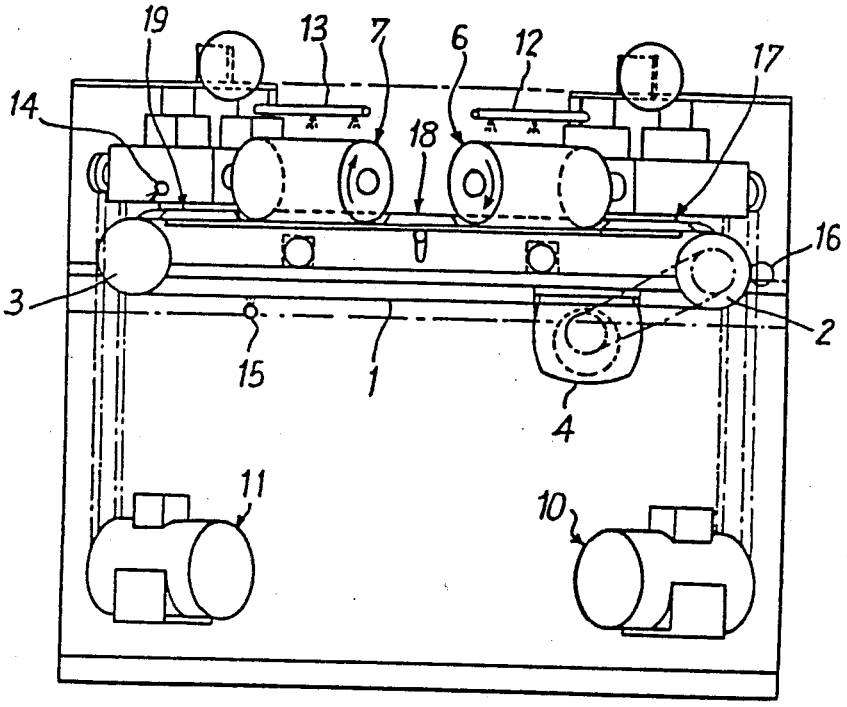
Figure 2:
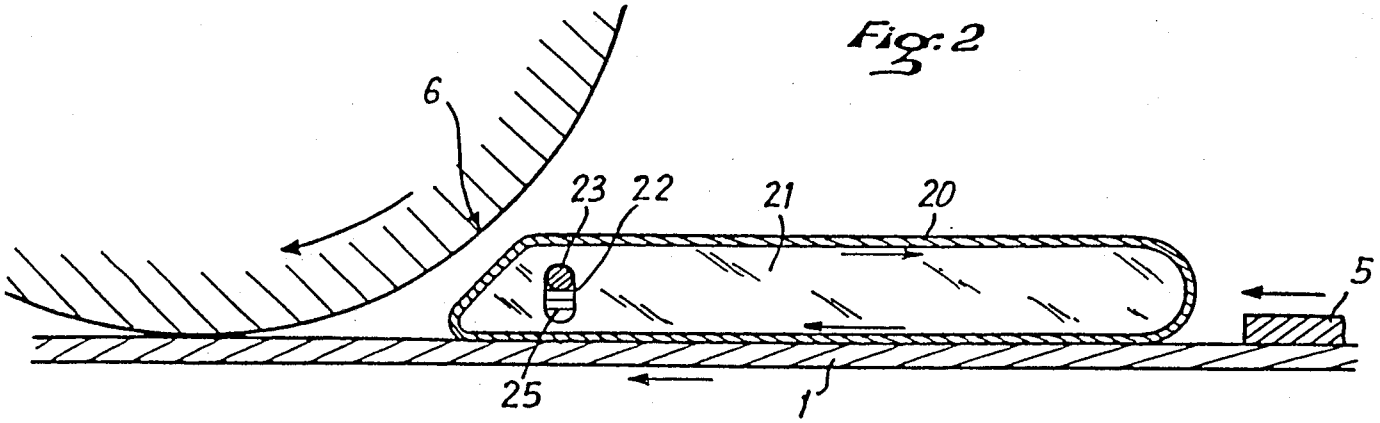
Figure 3:
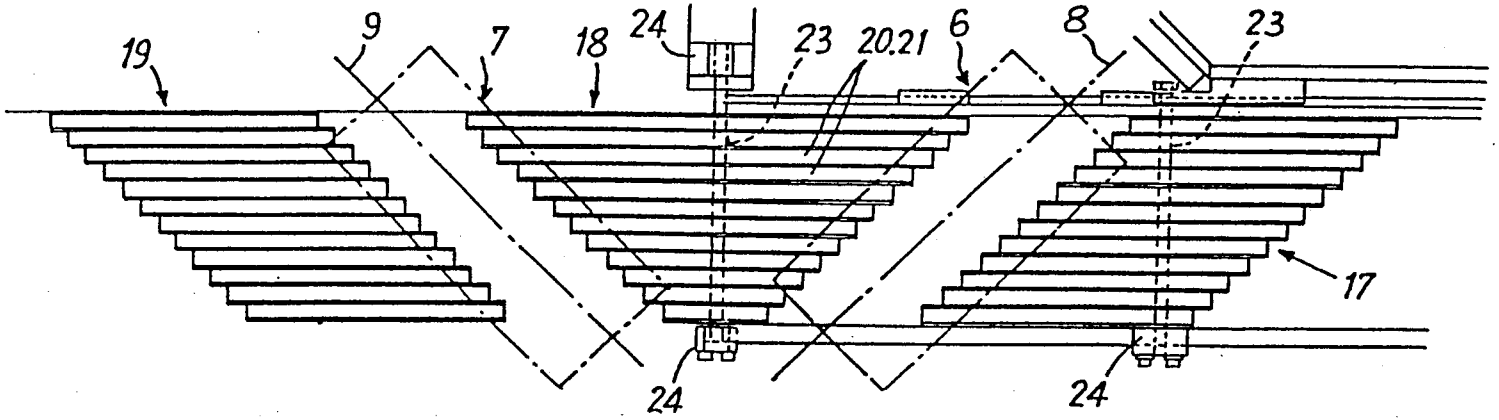

The present invention pertains to an automatic deburring machine for small parts.

We already know, as it is described in French patent No. 82 17 546 of the requesting party, a deburring machine including a conveyor mat upon which the parts to be deburred are carried and including one or more deburring head rotating above such conveyor mat, said heads being slightly tangential to the mat. The parts to be deburred which are carried by the conveyor mat, are therefore engaged successively between the mat and the deburring heads and they exit from the pincing zone free from burrs.

The present invention pertains to enhancements brought to this type of machine to improve the efficiency of the deburring operation and to perfectly maintain the parts before they enter into contact with the deburring heads.

To this effect, this automatic deburring machine for small parts including a conveyor mat upon which the parts to be deburred are carried and one or more deburring heads rotating above the conveyor mat, being slightly tangential to the mat is characterized by the fact that the deburring heads are rotating around axes which are inclined at a 45° angle with regard to the longitudinal axes of the conveyor mat and which are perpendicular between themselves and respectively above the deburring heads are located watering tracks which are vertical with regard to the rotation axis of the deburring heads.

Following is an description, as an example but without limitation, of the working operation of the present invention, by referring to the attached diagram upon which:

Diagram 1 is a stematic drawing of a deburring machine according to the invention.

Diagram 2 is a vertical and longitudinal sectional drawing, on a larger scale, of a pressuring element located before the deburring head.

Diagram 3 is a vertical drawing of the pressuring elements and the two deburring heads, these two heads supposedly being removed.

The deburring machine, according to the invention, includes an endless conveyor mat (1) rolling at its two extremities, respectively on a transmission roll (2) and a return roll (3). The transmission roll (2) is set in rotation in an element (4) which includes an electric motor, variable transmission and a reduction deassembler. The conveyor mat (1) is made of anti-skidding materials. The parts which need to be deburred (5) of which one is represented on the drawing (2) are carried on the upper side of the conveyor mat (1) which rolls from the right to the left on the drawing.

Above the upper side of the conveyor mat (1) there are two deburring heads (6,7) made of wheels or cylinders which are tangent to the upper side of the conveyor mat (1). These deburring heads (6,7) are set in rotation around respective axes (8,9) which are inclined at a 45° angle from the longitudinal axis of the conveyor mat (1) and which are perpendicular between themselves. The deburring heads (6,7) rotate by going downstream i.e. that their lower part turn in the same way as the upper part of the conveyor mat (1) from the right to the left of the drawing. Appropriate transmission gears from respective electric motors (10,11) located on the lower part of the machine set the deburring head (6,7) in rotation.

Respectively above the deburring heads (6,7) are located watering tracks (12,13) which are located in vertical lines through the axes of rotation (8,9).

The machine includes also a washing track (14) which cleans the parts upon their exit of the machine, this track stretching crosswise and above the far left end of the upper side of the conveyor mat (1). Moreover, a washing track (15) is located crosswise and under the lower side of the conveyor mat (1) and a drying roller (16) is pressed against the conveyor mat (1) where it is against the transmission roll (2).

Pressing elements (17,18,19) each made of several endless parallel and adjacent belts (20) lying longitudinally and mounted on stainless steel floating supports (21) are mounted at the entrance of the first deburring head (6), between the two deburring heads (6,7) and at the exit of the second deburring head (7). As it can be seen on Diagram 3, the belts (20) and the supports (21) of the first pressing element (17) define when viewed from above a perimeter with the shape of a parallelogram perimeter of which the two largest sides are parallel to the rotation axis (8) of the first deburring head (6), those of the second element or intermediate element (18) define a perimeter with the shape of a trapeze while those of the third element (19) define a perimeter in the shape of a parallelogram symmetrical to the first element (17) with respect to a transversal axis. As a result, the belts (20) and supports (21) of the first and third pressing elements (17,19) have all the same length while the length of those of the second intermediary element increase progressively in the transverse way. Each floating support (21) of a belt (20) lying lengthwise is made of a rod with a vertical port (22). The longitudinal position of the port (22) of the various floating supports (21) of a same set is selected in such a way that all the ports (22) are aligned crosswise in order to be crossed by a holding stem (23) stretching horizontally and crosswise. This stem (23) is held at its two extremities in lateral supports (24).

As it can be better seen in Diagram 2, each floating support (21) has, at its downside extremity next to the deburring head or wheel (6), a bevelled profile which enables it to get as close as possible to the deburring head. As a result, each belt (20), carried by a floating support (21), is moved longitudinally by simple contact with the conveyor mat (1) and reaches the proximity of the working area of the deburring wheel or head. The parts (5) brought by the conveyor mat (1) are thus inserted between the belts (20) and the conveyor mat (1) by lifting the floating support (21), and they are guided and maintained until they reach the working point of the deburring wheel (6). During their transfer the parts to be deburred (5) are subjected to a pressure generated on one hand by the weight of the floating supports (21) and on the other hand by compressed elastic little bars (25) which are engaged transversally in the ports (22), between the upper holding stem (23) and the lower extremities of the ports (22).

One can see from the above description that the parts to be deburred (5) are well kept in place as a result of the combined use of the anti-skid conveyor mat (1) which is maintained dry by the roller (16), and by the continued pressure of the belts (20) on the whole length of the parts as they progress on the conveyor mat (1).

I claim:

1. Surface abrading apparatus for deburring parts of relatively small size including:

(a) an endless conveyor mat upon which parts are carried;

(b) at least first and second abrasive heads, each abrasive head spanning the width of said conveyor mat and rotatively mounted in overlying tangential relation to the conveyor mat about an axis positioned at an angular orientation to the longitudinal axis of the conveyor mat and wherein the rotational axes of said first and second abrasive heads are perpendicular with respect to one another; and (c) at least first and second parts presser members overlying said conveyor mat, each including a plurality of endless belts rotatively mounted in independent adjacent parallel relation to one another and the longitudinal axis of said conveyor mat and each including means for resiliently biasing each belt in contact with the conveyor mat to transfer parts to and from said first and second heads.

2. Apparatus as set forth in claim 1 including a third parts presser member for transferring parts from said second abrasive head.

3. Apparatus as set forth in claim 2 wherein at least one side of each of said first and third parts presser members are mounted parallel to the axis of rotation of the first and second abrasive heads and wherein two sides of the second parts presser member are mounted parallel to the axis of rotation of the first and second abrasive heads.

4. Apparatus as set forth in claim 3 wherein the belts of said first and third presser members are all of equal length and the belts of the second parts presser member are progressively shorter in length from one side of the conveyor mat to the other.

5. Apparatus as set forth in claim 1 including a transversely mounted parts washing means at a parts outfeed end thereof.

6. Apparatus as set forth in claim 5 including means for washing said conveyor mat as it returns to a parts in-feed end.

7. Apparatus as set forth in claim 6 including a drying roller contacting said conveyor mat in the region between said conveyor mat washing means and the parts in-feed end thereof.

8. Apparatus as set forth in claim 1 wherein the belts of each presser member are rotatively mounted about a support frame having vertically elongated ports through the sides thereof and wherein each presser member is resiliently suspended about a rod member passing through its side ports.

9. Apparatus as set forth in claim 1 wherein the side of each presser member adjacent said first and second abrasive heads is vertically beveled to extend beneath and as close as possible to the area of contact of the abrasive head with the conveyor mat.

10. Apparatus as set forth in claim 8 wherein each pressing member includes a plurality of spring members mounted about said rod member to individually bias each belt towards said conveyor mat.

11. Apparatus as set forth in claim 1 wherein each of said first and second heads are mounted at forty-five degrees to the longitudinal axis of the conveyor mat.

12. Surface abrading apparatus for deburring parts of relatively small size including:

(a) an endless conveyor mat upon which randomly disposed parts are carried;

(b) at least first and second abrasive heads, each abrasive head spanning the width of said conveyor mat and rotatively mounted in overlying tangential relation to the conveyor mat about an axis positioned at an angular orientation to the longitudinal axis of the conveyor mat and wherein the rotational axes of said first and second abrasive heads are perpendicular with respect to one another;

(c) first and second watering tracks mounted in axially parallel overlying relation to said first and second abrasive heads; and (d) first, second and third parts presser members overlying said conveyor mat and mounted respectively at an in-feed side of the first abrasive head, between the abrasive heads and at an out-feed side of the second abrasive head, each including a plurality of endless belts rotatively mounted in independent adjacent parallel relation to one another and the longitudinal axis of said conveyor mat and each including means for resiliently biasing each belt in contact with the conveyor mat to transfer parts to and from said first and second heads.

13. Abrading apparatus for deburring parts of relatively small size including:

(a) an endless conveyor mat upon which randomly disposed parts are carried;

(b) at least first and second abrasive heads, each abrasive head spanning the width of said conveyor mat and rotatively mounted in overlying tangential relation to the conveyor mat about an axis positioned at a forty-five degree angular orientation to the longitudinal axis of the conveyor mat and wherein the rotational axis of said first and second abrasive heads are perpendicular with respect to one another;

(c) a plurality of rod members overlying said conveyor mat and secured to a framework supporting said conveyor mat; and (d) first, second and third parts presser members overlying said conveyor mat, each parts presser member including a plurality of endless belts rotatively mounted in adjacent parallel relation to one another and the longitudinal axis of said conveyor mat, having at least one beveled side mounting in parallel relation beneath one of the first and second abrasive heads, and supported from one of said rod members extending through an elongated transverse side port of a belt support frame, and wherein further each belt is biased toward said conveyor mat via spring members mounted about said rod members.

* * * * *